United States Patent [19]

Bianchi et al.

[11] 4,120,554

[45] Oct. 17, 1978

[54] COAXIAL CABLE CONNECTOR

[75] Inventors: Edward Armond Bianchi; Edger Wilmot Forney, Jr., both of Harrisburg, Pa.

[73] Assignee: AMP Incorporated, Harrisburg, Pa.

[21] Appl. No.: 820,504

[22] Filed: Aug. 1, 1977

[51] Int. Cl.[2] ..... H01R 11/20

[52] U.S. Cl. ..... 339/97 R; 339/177 R

[58] Field of Search ..... 339/97 R, 97 C, 97 P, 339/97 T, 98, 99 R, 177

[56] References Cited

U.S. PATENT DOCUMENTS

| | | | |
|---|---|---|---|
| 2,279,794 | 4/1942 | Olson | 339/97 C |
| 2,615,948 | 10/1952 | Kamen | 173/324 |
| 2,624,771 | 1/1953 | Hanson | 173/324 |
| 2,798,204 | 7/1957 | Bennett | 333/6 |
| 2,805,399 | 9/1957 | Leeper | 339/97 P |
| 2,843,827 | 7/1958 | Blonder | 339/97 R |
| 3,083,349 | 3/1963 | Blonder | 339/98 |
| 3,194,877 | 7/1965 | Collier | 174/88 |
| 3,457,359 | 7/1969 | Soucy | 174/47 |
| 3,546,365 | 12/1970 | Collier | 174/78 |
| 3,675,181 | 7/1972 | Lankford et al. | 339/32 R |
| 3,688,247 | 8/1972 | Prodel | 339/98 |
| 3,744,007 | 7/1973 | Hovak | 339/97 R |
| 3,787,797 | 1/1974 | Kurz | 339/95 R |
| 3,828,298 | 8/1974 | Schumacher | 339/14 R |
| 3,923,363 | 12/1925 | Kraft | 339/97 R |

*Primary Examiner*—Joseph H. McGlynn

[57] ABSTRACT

A coaxial cable connector comprising first and second matable housing means each having a semi-cylindrical channel formed therein which coincide when the housing means are mated to form one full cylindrical channel in which the cable is retained. A center conductor probe and a braid tap extend out of the semi-cylindrical channel of said first housing means to penetrate the cable as the housing means are mated. The braid tap comprises a pair of prongs secured to a common plate. The prongs penetrate the braid and, as the housing means are fully mated, the metal supporting plate bends to rotate the prongs towards each other to grip the braid therebetween. A spring loaded back-up probe is advanced from the semi-cylindrical channel in said second housing means after mating of the housing means to penetrate the cable and press against the center conductor thereof opposite the contact point of the center conductor probe.

17 Claims, 8 Drawing Figures

COAXIAL CABLE CONNECTOR

BACKGROUND OF THE INVENTION

This invention relates generally to a connector means for electrically connecting to a coaxial cable and more specifically the invention relates to a connector comprising contact means for tapping into the braid and also into the center connector of a coaxial cable at selected points along the length of such cable, and removable from said cable without massive disturbance of the impedance characteristics of the cable.

There are presently available several structures adapted to make connection with a coaxial cable along the length thereof by making separate connections to the insulative braid and the internal center conductor. Most of these prior art connectors employ one or more pins which penetrate into the braid and relies on the resiliency of the braid to maintain the electrical connection. The connection to the center conductor of the coaxial cable is effected with a probe which penetrates through the cable and has its pointed end press against the cable center conductor. In both the braid connection and the center conductor probe the electrical connection is subject to deterioration due to several causes. Such causes include creep of the metal, such as the braid and the center conductor, away from the connections made thereto, and also corrosion of the contacting surfaces by moisture and other corrosive effects in the atmosphere which can penetrate between the contact connections and the braid and the center conductor of the cable because of insufficient force between such connections.

BRIEF STATEMENT OF THE INVENTION

It is a primary object of the invention to provide a coaxial connector which can be attached to and removed from the cable at selected points along the length thereof without producing massive disturbance to the cable during such connections thereto or after removal therefrom.

It is another primary purpose of the invention to provide a coaxial cable connector in which the connection to the braid of the cable resiliently grips a portion of the cable braid to minimize loss of electrical ensure continued therewith because of deterioration, such as creep of the metal or contamination of the contact surfaces due to moisture or other corrosive materials in the atmosphere.

A third object of the invention is to provide a coaxial cable connector in which the conductive probe, which connects to the center conductor, is opposed by a spring-loaded insulated back-up probe positioned opposite thereto to ensurecontinued good electrical contact between the conductive probe and the center conductor.

A fourth aim of the invention is to provide a coaxial connector in which the connections to the braid and to the center conductor are both spring-loaded to ensure good long-term electrical connection and which are constructed to avoid substantial disturbances in the impedance of the cable either during the presence of the connector or after the connector has been removed from the cable.

A fifth aim of the invention is to provide a coaxial connector a fifth aim of the invention is to provide a coaxial connector in which the connections to both the braid and the center conductor are effected by bringing together two portions of the connector housing with the cable held securely in a fixed, predetermined position between the two housing portions as they are brought together.

In accordance with one embodiment of the invention the coaxial connector comprises first and second housing portions, with the first housing portion containing a center conductor probe and a braid tap which are caused to penetrate through the cable sheath and to make a contact respectively with the center conductor and with the braid as the two housing portions are mated together. A spring-loaded back-up probe which is retained in the second housing portion is then caused to penetrate into the cable and to press against the center conductor thereof opposite the position of the center conductor probe. The braid tap can be a two pronged contact connected together by a metal plate. As the two housing portions of the connector are brought together, the two prongs penetrate the braid and the connecting metal plate is caused to be bent over about its center line between the two prongs to rotate the two prongs towards each other and thereby resiliently grip a portion of the braid therebetween.

As an alternate embodiment the conductive center conductor probe can be spring loaded rather than the back-up probe. In a third embodiment a spring loaded conductive center conductor probe can be empolyed without a back-up probe.

In accordance with a feature of the invention each of the two housing portions has a semi-cylindrical channel formed therein with the two semi-cylindrical channels being positioned opposite one another when the two housing portions are mated to form a complete cylindrically cross-sectioned channel which retains the coaxial cable. The cable is placed in the semi-cylindrical channel in one of the housing portions prior to mating of said each other portions. The braid tap and the conductive center conductor probe are positioned in the semi-cylindrical channel of the second housing channel so that when the two housing portions are mated together the braid tap and the center conductor probe will penetrate into the coaxial cable to make contact with the braid and the center conductor respectively.

In accordance with another feature of the invention the braid tap can comprise two pairs of prongs with a connecting metal plate spanning the two prongs of each of the pairs of braid taps. The metal plate is bent about a center line extending between the individual prongs of each of the two pairs of prongs to cause the prongs of each pair of prongs to rotate towards eachother after penetration into the braid to resiliently grip a portion of the braid therebetween and thereby ensure a good continued electrical contact between the braid tap and the braid.

In accordance with still another feature of the invention a back-up probe, preferably of insulative material, but which can also be of matel if insulated from the braid, is retained within the first housing portion, and after mating of the first and second housing portions, is moved forward to penetrate into the coaxial cable and press against the center conductor at a point opposite the contact point of the conductive center conductor probe and the center conductor of the cable. The back-up probe is spring-loaded in order to maintain a constant pressure against the center conductor and thereby force it continuously against the conductive probe on the other side of the center conductor.

BRIEF DESCRIPTION OF THE DRAWINGS

The above-mentioned objects and features of the invention will be more fully understood from the following detailed description thereof when read in conjunction with the drawings in which.

DETAILED DESCRIPTION OF THE INVENTION

Figure 1:
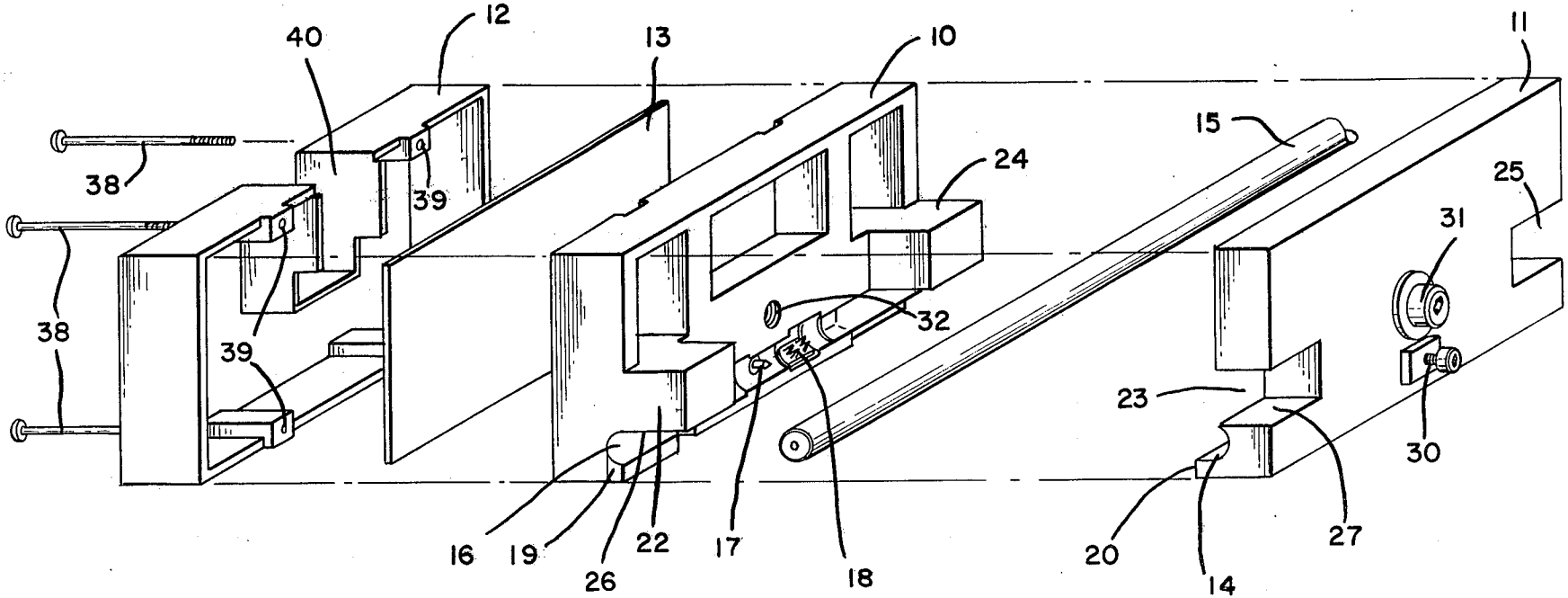
FIG. 1 is an isometric and exploded view of the complete connector assembly.

Referring first to FIG. 1 the connector housing comprises two main portions 10 and 11. A third housing portion 12 fits on the rear of housing portion 10. A printed circuit board 13 is positioned between housing portions 10 and 12 and to which the contacts of the present invention connect the braid and the center conductor of coaxial cable 15.

The two housing portions 10 and 11 contain semi-cylindrical channels 16 and 14, respectively, which form a resultant cylindrical channel when the two housing portions 10 and 11 are mated together. The coaxial cable 15 is retained within said resultant cylindrical channel. More specifically, coaxial cable 15 is placed in semi-cylindrical channel 14 before housing portions 10 and 11 are mated. As the housing portions 10 and 11 are mated the conductive probe 17 and the braid tap 18 penetrate into cable 15 to the center conductor thereof and the braid thereof respectively.

It will be noted that the housing portion 11 has a lip 20 positioned below the semi-cylindrical channel 14, which lip fits in a mating groove 19 under the semi-cylindrical channel 16. It is apparent that lip 20 will ride under the top edge of groove 19 during mating of the halves 10 and 11 and thereby form a surface upon which the cable 15 is supported as the housings 10 and 11 complete their mating. Similarly, elements 22 and 24 fit into grooves 23 and 25 of housing portion 11 with the bottom surfaces thereof, such as bottom surface 26, mating with the surface 27 of housing portion 11 to form a limiting top surface for the cable 15 as the housing portions 10 and 11 are completing their mating. Thus, the position of the cable 15 is locked into the semi-cylindrical channel 14 as the two housing portions 10 and 11 are mated and cannot move either up or down to become misaligned with the center conductor probe 17 or the braid tap 18 during such mating.

Once mated there is provided a screw or bolt 31 in the housing portion 11 which mates with the threaded aperture 32 in the housing portion 10 to hold the two housing portions 10 and 11 securely together.

The back-up probe screw 58 in housing 11 is then turned to advance the back-up probe 30 into cable 15 to a point on center conductor 35 which is opposite the point of contact of the center conductor probe 17 secured in the channel 16 of housing portion 10.

It is to be noted that in FIG. 1 only the rear of the insulative back-up probe assembly 30 can be seen. A more detailed showing of the back-up probe is shown in FIG. 2 which will be discussed later herein in more detail.

In order to connect the coaxial cable 15 to an external circuit, such as printed circuit board 13, a third housing element 12 is provided. The housing element 12 is securable to the back of housing element 10 by means of screws 38 which extend through apertures 39 inhousing element 12 and into threaded apertures provided in the rear of the housing element 10. A cut-out portion 40 is provided in housing element 12 so that a connector (not shown in FIG. 1) can be inserted into appropriate mating receptacles in circuit board 13 to connect said circuit board 13 to another external circuit (not shown).

Figure 2:
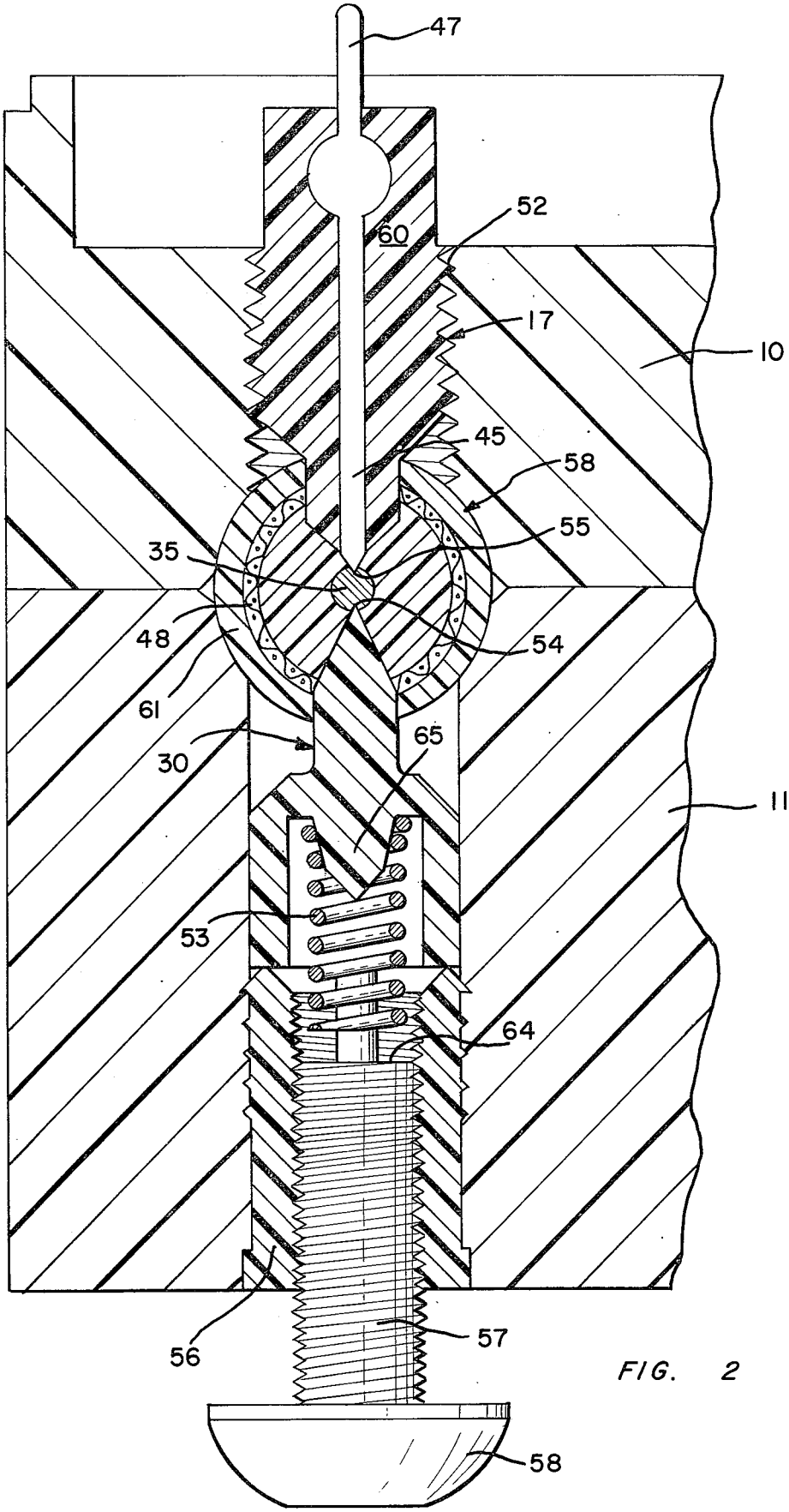
FIG. 2 shows a sectional view of the portions of the connector mated retaining a coaxial cable therebetween, with the conductive center conductor probe of the connector making contact with the center conductor of the cable and a spring-loaded back-up insulative probe pressing against said center conductor opposite the conductive center conductor probe.

Referring now to FIG. 2 there is shown a sectional view of the two halves 10 and 11 of the housing mated together around the coaxial cable 15. The center conductor 17 is shown secured within the housing portion 10 by means of threaded surfaces 52 with the conductive metal probe 45 portion being encapsulated in the plastic portion 60 of said probe 17. It is to be noted that probe 17 can be force fitted into housing portion 10 rather than by the use of threads.

The probe 17 is shown as having penetrated through the plastic sheath 61 and the metal braid 48 of coaxial cable 15, with the tip 55 of the conductive probe 45 biting into the center conductor 35 of the coaxial cable 15.

The back-up probe 30 is shown after having its point 54 forced through the plastic sheath 61 and the braid 48 of the coaxial cable 15 and into the center conductor 35 opposite the contact point 55 of the conductive probe 45. Back-up is spring-loaded by means of a spring 53. More specifically, the threaded shaft 57 is rotated by a knob 58 to move the shaft 57 inwardly into the threaded insert 56. As the shaft 57 moves into the threaded insert 56 the end surface 64 thereof transmits a force through the spring 53 and onto the plastic portion 65 of the back-up probe 30 and thereby forces the point 54 of the back-up probe 30 through the coaxial cable, as described above, and against the center conductor 35 thereof. Because of the spring loading of back-up probe 65 upon center conductor 35 the force between the conductive probe 45 and the center conductor 35 will remain high even though creep might occur in the conductive center conductor 35 of the coaxial cable.

Returning again to the metal portion 45 of probe 17 the upper end 47 thereof extends out beyond the housing 10 so that said end 47 can make suitable contact to an external circuit, such as a female receptacle mounted on the printed circuit board 13 of FIG. 1.

Figure 3:
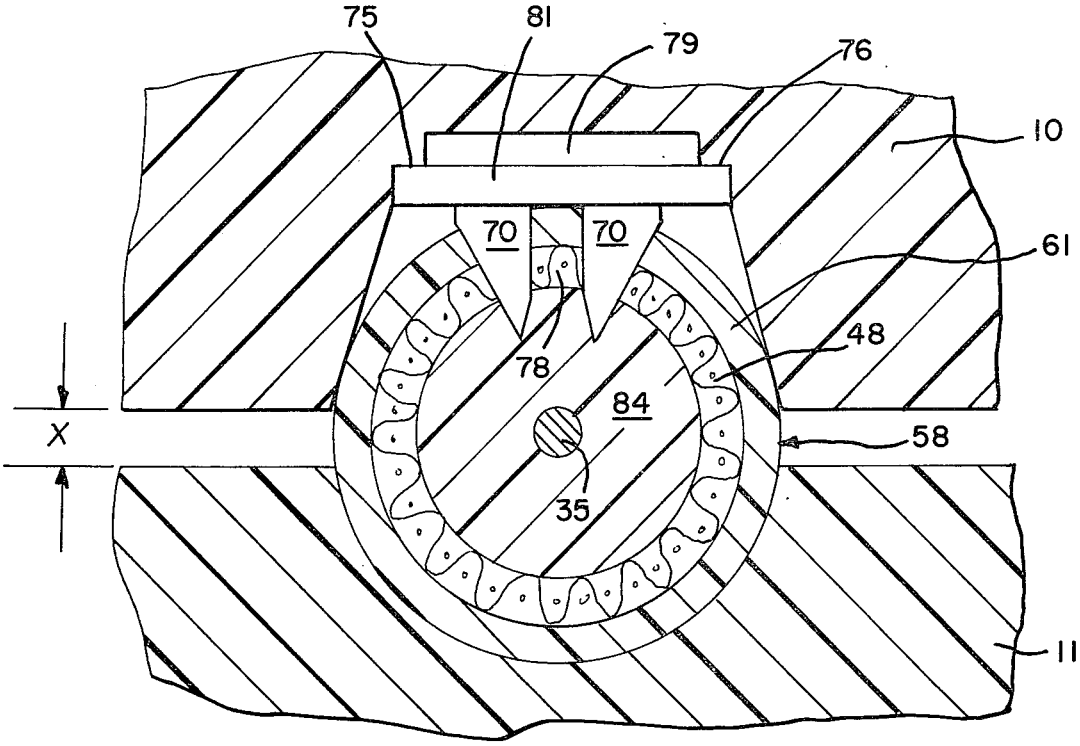
FIG. 3 shows a two pronged braid tap penetrating through the braid of the coaxial cable.
Figure 4:
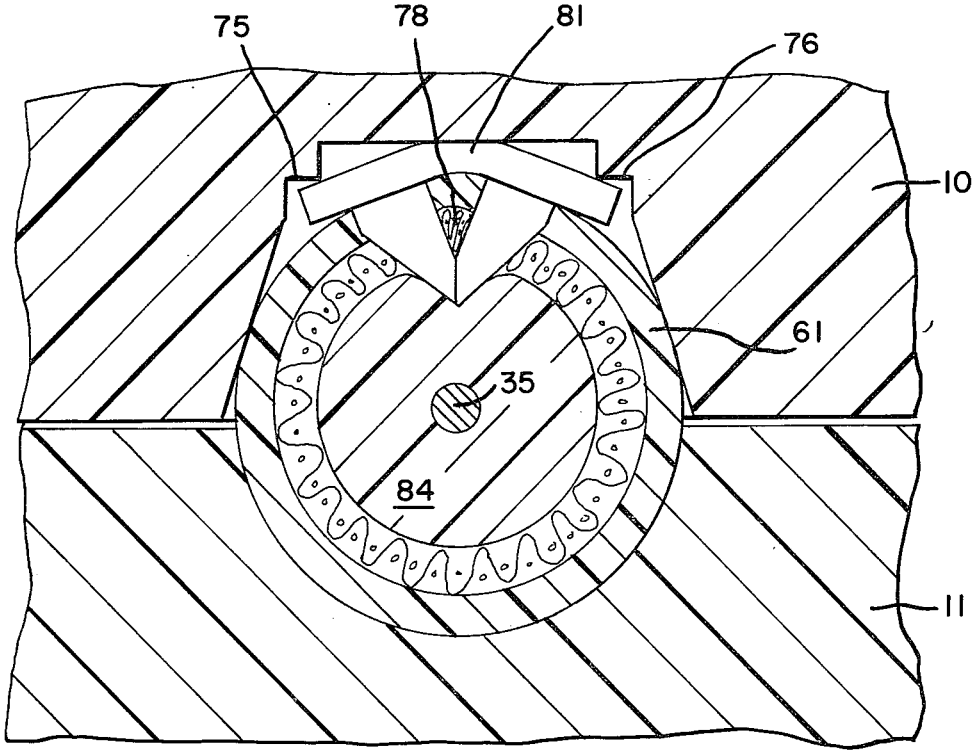
FIG. 4 shos the two pronged braid tap of FIG. 3 after the bending of the metal plate joining together the two prongs rotates the two prongs toards each other to grip a portion of the braid therebetween.

Referring now to FIGS. 3 and 4 there are shown two views of the braid tap contact of the connector. Such contact is shown in three dimension in FIG. 5 and can be seen to consist of two pairs of contacts, one being designated by reference character 70 and the other by reference character 80. The two pairs of prongs 70 and 80 are connected to a metal plate 81 which is bendable along a line extending between the prongs of each pair of prongs.

In FIG. 3 only the pair of prongs 70 are shown since it is a sectional view. Also shown is the connecting metal plate 81 which fits under the shoulders 75 and 76 of a cavity 79 formed in the plastic housing portion 10. In FIG. 4 the two prongs 70 are shown after they have been inserted through the plastic sheath 61 of the coaxial cable 15 and also the braid 48 and into the plastic portion 84 of the cable. It can be seen that the two housing portions 10 and 11 are not completely mated in FIG. 3 but are separated by a distance X.

In FIG. 4 the two plastic housing portions 10 and 11 are fully mated and the braid tap is fully inserted. It can be seen that the edges of the metal plate 81 have been forced down by the shoulders 75 and 76 formed in the housing portion 10 while the center portion of metal plate 81 is supported by the cable. As the metal plate 81 bends along its centerline, that is along the line extending between the prongs of each pair of prongs, the two prongs 70 rotate towards each other, as shown in FIG. 4, to grip the portion 78 of the cable braid therebetween. Both the braid contact and the braid portion 78 have a degree of resiliency so that a residual spring force is retained between the prongs 70 and the braid 78 trapped therebetween.

Figure 5:
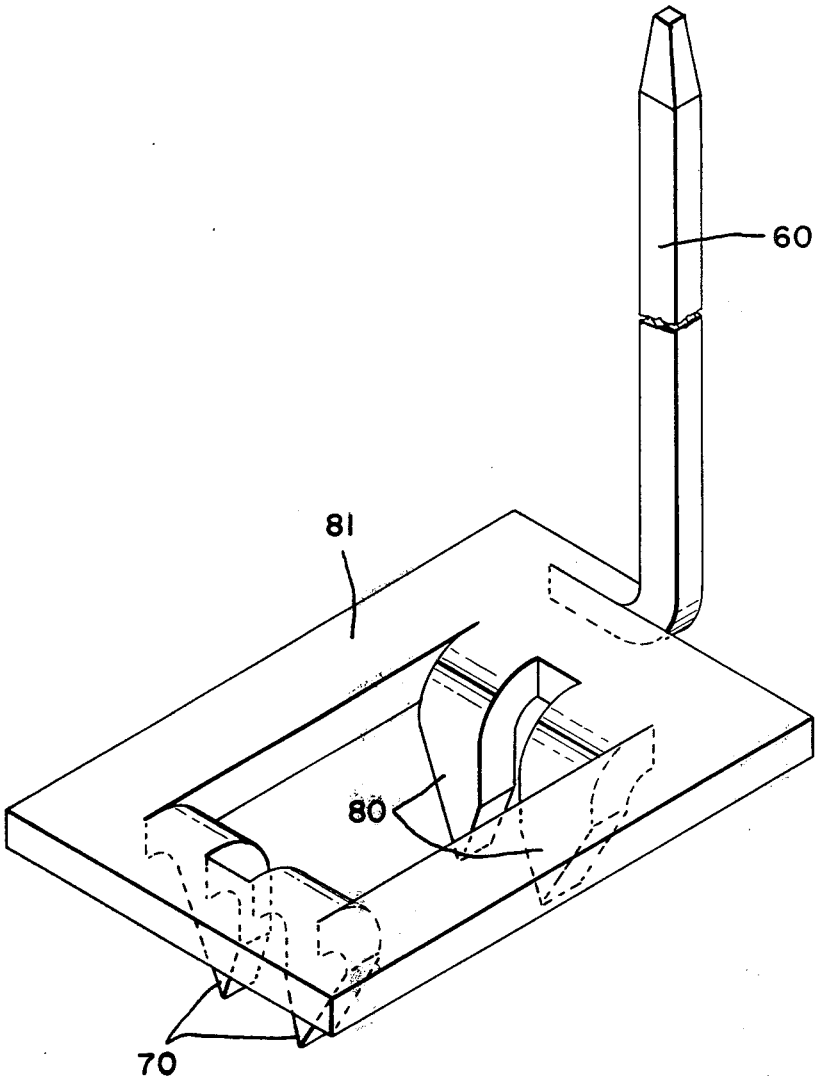
FIG. 5 is an isometric view of the braid tap contact.
Figure 6:
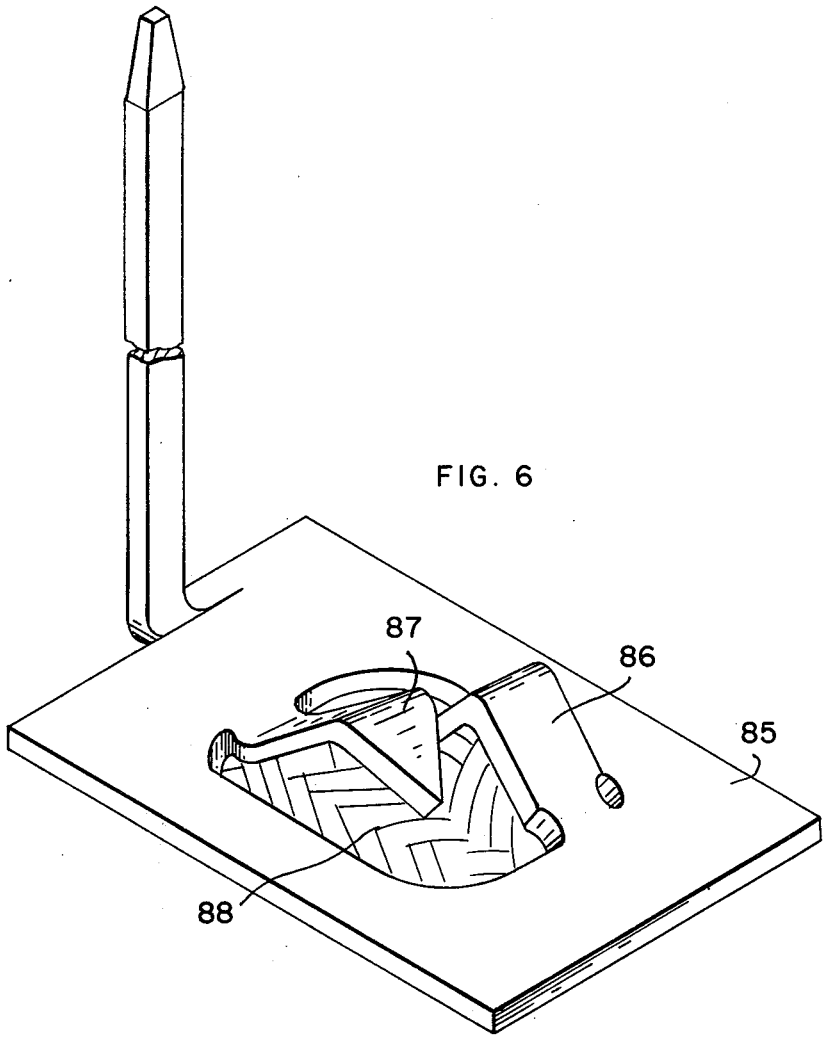
FIGS. 6 and 7 are isometric views of another form of a braid tap contact which can be employed in the invention in lieu of the braid tap of FIGS. 3 and 4.
Figure 7:
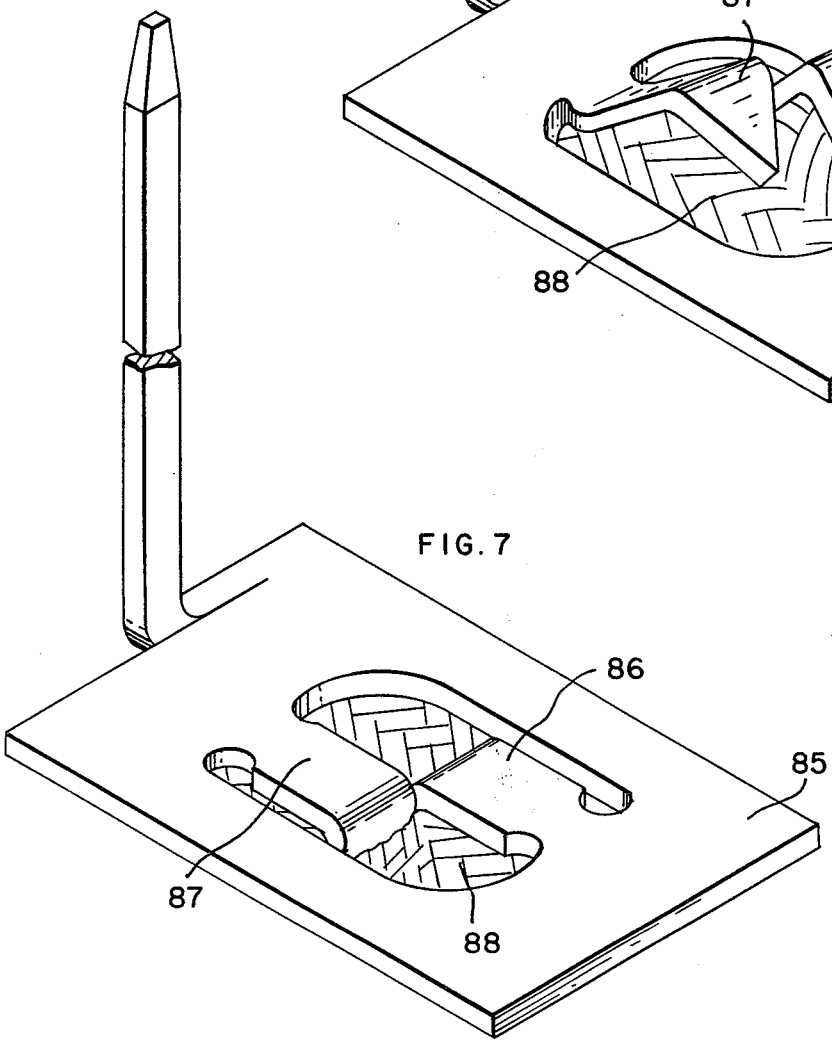

FIGS. 6 and 7 show another form of braid tap that can be employed in the invention in lieu of the braid tap shown in FIGS. 3, 4 and 5. The two fingers 86 and 87 are supported on a metal plate 85 which can be substituted for and positioned similarly to the braid tap 18 shown in FIG. 1. In FIG. 6 the two fingers 86 and 87 are shown poised above the braid 88 of a coaxial cable.

FIG. 7 shows the two fingers 86 and 87 after penetration into the braid has been effected by the bringing together of the two portions 10 and 11 of the housing with the cable positioned in the semi-cylindrical slots 16 and 14.

Figure 8:
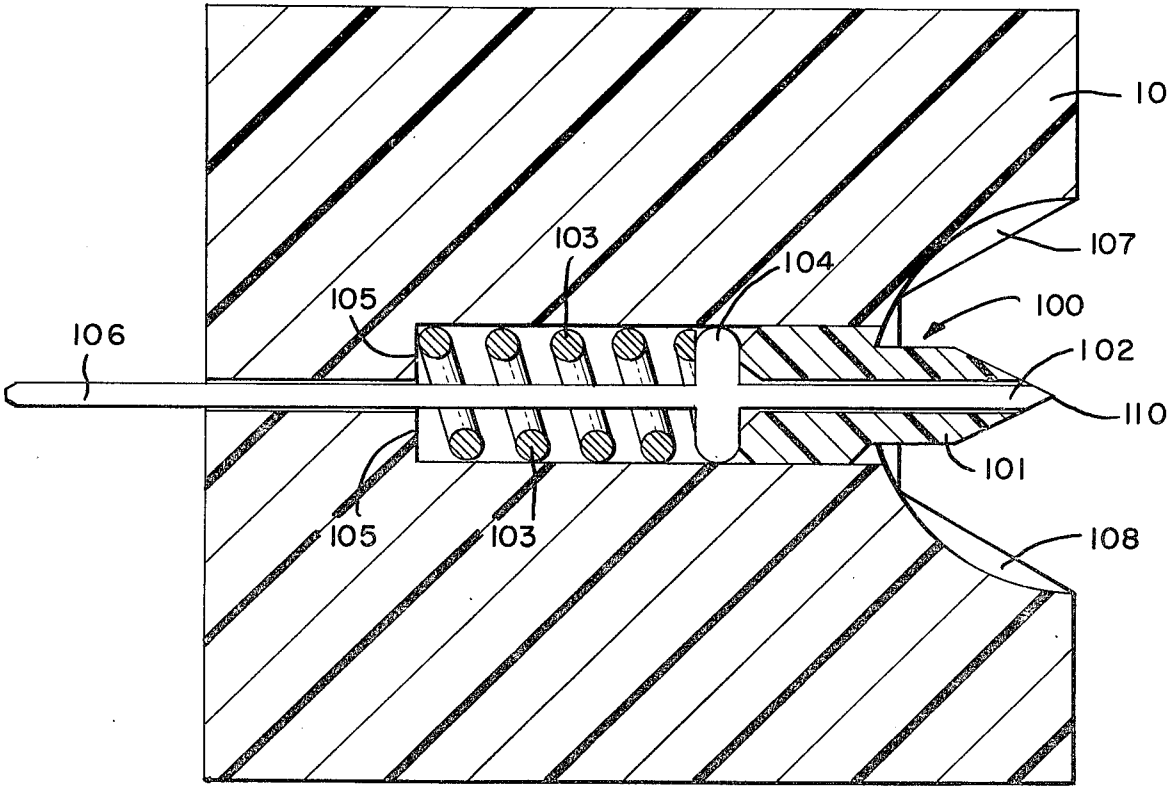
FIG. 8 is a sectional view of a form of the invention wherein a spring loaded conductive center conductor probe is employed without a back-up probe.

Referring now to FIG. 8 there is shown a form of the invention in which the conductive center conductor probe assembly 100 is spring loaded by means of a spring 103 which is positioned between the enlarged portion 104 of the metal conductor probe 102 and the shoulders 105 formed in the plastic housing portion 10.

In the form of the invention of FIG. 8 a back-up probe, such as the type shown in FIG. 2 and represented by reference character 30, can be employed or, if desired, can be omitted. If a back-up probe is employed it is not necessary that it be spring loaded since the conductive center conductor probe 100 of FIG. 8 is spring loaded. However, if desired the back-up probe can be spring loaded as well as the conductive center conductor probe.

The conductive center conductor probe 100 of FIG. 8 comprises the conductive probe portion 102 which is partially surrounded with insulative sheath 101. The insulative sheath 101 functions to insulate the conductive probe portion 102 from the braid of the cable (not shown in FIG. 8). The point 110 of the metal probe 102 penetrates into the coaxial cable (not shown) and becomes embedded in the outer surface of the center conductor thereof in much the same manner as the point 55 of probe 17 of FIG. 2. The tail end 106 of the probe assembly 100 is similar to the post-like termination 47 of probe 17 of FIG. 2 and is employed to make contact with a female receptacle mounted on a printed circuit board, or other suitable receiving means.

The ribs 107 and 108 formed in the plastic housing 10 perform the function of gripping the plastic sheath of the cable (not shown) and prevent its longitudinal movement once the two housing portions 10 and 11, as shown in FIG. 2, are mated.

It is to be understood that the forms of the invention shown and described herein are but preferred embodiments thereof and that various changes can be made without departing from the spirit or scope of the invention.

We claim:

1. A coaxial cable connector comprising:

first and second matable housing means comprising means for retaining a coaxial cable having a center conductor and an outer conductor in a predetermined position as said first and second housing means are mated;

a first conductive center conductor probe having an insulative sheath therearound position in said first housing means to penetrate into said coaxial cable and press against said center conductor of said coaxial cable as said first and second housing means are mated, with said insulative sheath insulating said conductive probe from the outer conductor of said coaxial cable;

a spring loaded back-up probe position in said second housing means to penetrate into said coaxial cable and press against the center conductor thereof at a point opposite said first probe; and contact means positioned in one of said first and second housing means to penetrate and make contact with said outer conductor.

2. A connector as in claim 1 in which said contact means comprises:

at least one pair of prongs joined together by a supporting plate and extending outwardly from said one housing means to penetrate said outer conductor of said coaxial cable as said first and second housing means are being mated;

said one housing means constructed to bend the said supporting plate partially around said coaxial cable as said first and second housing means are mated to move the ends of said prongs toward each other and thereby grip the penetrated outer conductor therebetween.

3. A connector as in claim 1 in which said contact means comprises:

at least one pair of resilient prongs secured to a common supporting plate and extendable outwardly from said one housing means to penetrate the said outer conductor of said coaxial cable as said first and second housing means are being mated;

said one housing means constructed to bend the said pair of prongs outwardly from said one housing means as said housing means are mated to penetrate the said outer conductor of said coaxial cable.

4. A connector as in claim 1 in which:

said first housing means comprises a first semi-cylindrical channel formed therein;

in which said second housing means comprises a second semi-cylindrical channel formed therein which is positioned opposite said first semi-cylindrical channel when said first and second housing means are mated to form a resultant cylindrical channel which retains said coaxial cable in said predetermined position;

in which said first conductive center conductor probe is positioned to extend out from said first semi-cylindrical channel to penetrate said coaxial cable and press against the center conductor thereof; and in which said back-up probe is adjustably secured within said second housing means to be extendable outwardly from said second semi-cylindrical channel and against the said center conductor opposite the contact point of said first probe after said first and second housing means are mated.

5. A connector means for connecting to a coaxial cable having a center conductor and an outer conductor and comprising:

first and second matable housing means with first and second semi-cylindrical channels formed therein, respectively;

said first and second semi-cylindrical channels being positioned to form a resultant cylindrical channel to retain the coaxial cable therein when said first and second housing means are mated;

a conductive center conductor probe with a portion thereof covered with insulation secured in said first housing means and extending from said first semi-cylindrical channel to penetrate said coaxial cable and to press into said center conductor to make electrical contact therewith when said first and second housing means are mated;

a spring-loaded back-up probe secured in said second housing means and extending outwardly from said second semi-cylindrical channel after said first and second housing means have been mated to penetrate said cable and press into said center conductor at a point opposite said contact point of said conductive center conductor probe; and contact means for contacting the outer conductor of said coaxial cable.

6. A connector as in claim 5 in which said contact means comprises:

at least one pair of prongs joined together by a supporting plate and extending outwardly from one of said housing means to penetrate said outer conductor of said coaxial cable as said first and second housing means are being mated;

said one housing means constructed to bend the said supporting plate around said coaxial cable as said first and second housing means are mated to move the ends of said prongs toward each other and thereby grip the penetrated outer conductor therebetween.

7. A connector as in claim 5 in which said contact means comprises:

at least one pair of prongs secured to a common supporting plate and extendable outwardly from one of said housing means to penetrate the said outer conductor of said coaxial cable as said first and second housing means are being mated;

said one housing means constructed to bend the said pair of prongs to extend outwardly from said one housing means to penetrate said outer conductor of said coaxial cable.

8. In combination, a coaxial cable having a center conductor and an outer conductor and connector means connecting to said coaxial cable and comprising:

first and second matable housing means with means for retaining said coaxial cable therebetween the mating surfaces of said housing means, as said housing means are mated together;

a conductive center conductor probe secured in one of said housing means to make contact with said center conductor of said coaxial cable;

outer conductor contact means positioned in one of said housings to penetrate and make contact with said outer conductor;

said braid outer conductor contact means comprising:

at least one pair of prongs joined together by a supporting plate and extending outwardly from said one housing means to penetrate said outer conductor of said coaxial cable as said first and second housing means are being mated;

said one housing means constructed to bend the said pair of prongs to extend outwardly from said one housing means to penetrate said outer conductor of said coaxial cable.

9. A combination as in claim 8 in which said conductive center conductor probe comprises an insulative sheath around a portion thereof and being positioned in said one of said housing means to penetrate said coaxial cable and press against said center conductor when said first and second housing means are mated and with said insulative sheath insulating said conductive probe from said outer conductor.

10. In combination, a coaxial cable having a center conductor and an outer conductor and connector means connecting to said coaxial cable and comprising:

first and second matable housing means with means for retaining said coaxial cable therebetween the mating surfaces of said housing means, as said housing means are mated together;

a center conductor probe positioned in one of said housing means to make contact with said center conductor of said coaxial cable;

outer conductor contact means positioned in one of said housing means to penetrate and make contact with said outer conductor;

said braid outer conductor contact means comprising:

at least one pair of prongs joined together by a supporting plate and extending outwardly from said one housing means to penetrate said outer conductor of said coaxial cable as said first and second housing means are being mated;

said one housing means constructed to bend the said supporting plate around said coaxial cable as said first and second housing means are mated to move the ends of said prongs towards each other and thereby grip the penetrated outer conductor therebetween.

11. A combination as in claim 10 in which said conductive center conductor probe comprises an insulative sheath around a portion thereof and being positioned in said one of said housing means to penetrate said coaxial cable and press against said center conductor when said first and second housing means are mated, and with said insulative sheath insulating said conductive probe from said outer conductor.

12. A coaxial cable connector comprising:

first and second matable housing means comprising means for retaining a coaxial cable having a center conductor and an outer conductor in a predetermined position as said first and second housing means are mated;

a first spring loaded conductive center conductor probe having an insulative sheath therearound positioned in said first housing means to penetrate into said coaxial cable and press against said center conductor of said coaxial cable as said first and second housing means are mated, with said insulative sheath insulating said conductive probe from the outer conductor of said coaxial cable;

a back-up probe positioned in said second housing means to penetrate into said coaxial cable and press against the center conductor thereof at a point opposite said first probe; and contact means positioned in one of said first and second housing means to penetrate and make contact with said outer conductor.

13. A connector as in claim 12 in which said contact means comprises:

at least one pair of prongs joined together by a supporting plate and extending outwardly from said one housing means to penetrate said outer conductor of said coaxial cable as said first and second housing means are being mated;

said one housing means constructed to bend the said supporting plate partially around said coaxial cable as said first and second housing means are mated to move the ends of said prongs toward each other and thereby grip the penetrated outer conductor therebetween.

14. A connector as in claim 12 in which said contact means comprises:

at least one pair of resilient prongs secured to a common supporting plate and extendable outwardly from said one housing means to penetrate the said outer conductor of said coaxial cable as said first and second housing means are being mated;

said one housing means constructed to bend the said pair of prongs outwardly from said one housing means as said housing means are mated to penetrate the said outer conductor of said coaxial cable.

15. A connector as in claim 12 in which:

said first housing means comprises a first semi-cylindrical channel formed therein;

in which said second housing means comprises a second semi-cylindrical channel formed therein which is positioned opposite said first semi-cylindrical channel when said first and second housing means are mated to form a resultant cylindrical channel which retains said coaxial cable in said predetermined position;

in which said first conductive center conductor probe is positioned to extend out from said first semi-cylindrical channel to penetrate said coaxial cable and press against the center conductor thereof; and in which said back-up probe is adjustably secured within said second housing means to be extendable outwardly from said second semi-cylindrical channel and against the said center conductor opposite the contact point of said first probe after said first and second housing means are mated.

16. A coaxial cable connector comprising:

first and second matable housing means comprising means for retaining a coaxial cable having a center conductor and an outer conductor in a predetermined position as said first and second housing means are mated;

a first spring loaded conductive center conductor probe having an insulative sheath therearound positioned in said first housing means to penetrate into said coaxial cable and press against said center conductor of said coaxial cable as said first and second housing means are mated, with said insulative sheath insulating said conductive probe from the outer conductor of said coaxial cable;

contact means positioned in one of said first and second housing means to penetrate and make contact with said outer conductor;

said contact means comprising:

at least one pair of prongs joined together by a supporting plate and extending outwardly from said one housing means to penetrate said outer conductor of said coaxial cable as said first and second housing means are being mated;

said one housing means constructed to bend the said supporting plate partially around said coaxial cable as said first and second housing means are mated to move the ends of said prongs toward each other and thereby grip the penetrated outer conductor therebetween.

17. First and second matable housing means comprising means for retaining a coaxial cable having a center conductor and an outer conductor in a predetermined position as said first and second housing means are mated;

a first spring loaded conductive center conductor probe having an insulative sheath therearound positioned in said first housing means to penetrate into said coaxial cable and press against said center conductor of said coaxial cable as said first and second housing means are mated, with said insulative sheath insulating said conductive probe from the outer conductor of said coaxial cable;

contact means positioned in one of said first and second housing means to penetrate and make contact with said outer conductor;

said contact means comprising;

at least one pair of resilient prongs secured to a common supporting plate and extendable outwardly from said one housing means to penetrate the said outer conductor of said coaxial cable as said first and second housing means are being mated;

said one housing means constructed to bend the said pair of prongs outwardly from said one housing means as said housing means are mated to penetrate the said outer conductor of said coaxial cable.

* * * * *

UNITED STATES PATENT OFFICE

CERTIFICATE OF CORRECTION

Patent No. 4,120,554 Dated October 17, 1978

Inventor(s) Edward A. Bianchi and Edgar W. Forney

It is certified that error appears in the above-identified patent and that said Letters Patent are hereby corrected as shown below:

IN THE CLAIMS:

Claim 1, column 6, line 19, "position" should read ---positioned---.

Claim 1, column 6, line 26, "position" should read ---positioned---.

Signed and Sealed this

Sixth Day of March 1979

[SEAL]

Attest:

RUTH C. MASON
*Attesting Officer*

DONALD W. BANNER
*Commissioner of Patents and Trademarks*